US006003983A

United States Patent [19]

Lowry et al.

[11] Patent Number: 6,003,983

[45] Date of Patent: Dec. 21, 1999

[54] CONTAMINANT CLEANED INKJET CARTRIDGE MANUFACTURE

[75] Inventors: Edwina Floyd Lowry; Christopher John Money, both of Lexington, Ky.

[73] Assignee: Lexmark International, Inc., Lexington, Ky.

[21] Appl. No.: 08/972,291

[22] Filed: Nov. 18, 1997

[51] Int. Cl.[6] ..... B41J 2/165

[52] U.S. Cl. ..... 347/85

[58] Field of Search ..... 347/22, 25, 28, 347/84, 85, 86, 87; 141/66; 257/149.8, 149.9, 215, 289, 290

[56] References Cited

U.S. PATENT DOCUMENTS 5,537,136 7/1996 Brandon et al. ..... 347/87

5,576,750 11/1996 Brandon et al. ..... 347/87

5,786,829 7/1998 Pasciak, Jr. et al. ..... 347/28

*Primary Examiner*—N. Le

*Assistant Examiner*—Anh T. N. Vo

*Attorney, Agent, or Firm*—John A. Brady

[57] ABSTRACT

In a clean room cups (70) are applied to the standpipe (28) of an unfilled inkjet cartridge. A sealing cup (80) is applied to the ink outlet (46, 48, 50) of the cartridge. Inert gas is forced back and forth between the cups and expelled into the clean room through a filter. Such cleaning removes particles, which significantly improves reliability of the filled cartridge.

4 Claims, 6 Drawing Sheets

CONTAMINANT CLEANED INKJET CARTRIDGE MANUFACTURE

FIELD OF THE INVENTION

This invention relates to the manufacture of cartridges for inkjet printers, and, more particularly, to the elimination of particles and other contaminants which could clog the nozzles during use.

BACKGROUND OF THE INVENTION

Inkjet printheads typically expel ink through very small nozzles on the printhead. In thermal inkjet printheads the ink is moved by vaporizing water or other component of the ink employing a semiconductor substrate (chip) having resistors proximate to each nozzle. The nozzles are very small and may become clogged.

To minimize clogging, prior art inkjet printheads contain a filter between the main reservoir for ink and the channel to the chip. Such filters are of a fine mesh which prevents any potentially-clogging contaminants from passing through the filter. In order to anchor the filter, each reservoir has a standpipe leading to its flow channel to the chip. The standpipe presents a round regular top to which the filter can be fixed by heat staking or other process. Also, inkjet printheads in the prior art are made in isolated, decontaminated "clean" rooms, such as those used for semiconductor manufacture.

It has been found in accordance with this invention that the foregoing standpipe and filter, and clean room manufacture, are only partly effective in eliminating clogging of nozzles from contamination. It is the premise of this invention that regions between the top of the standpipe and the end of channels to the chip are sources of contamination because they are functionally past the filter.

DISCLOSURE OF THE INVENTION

In accordance with this invention, it is recognized that the top of the standpipe can be clamped to one compliant sealing member opening to a first conduit and the ends of channels can be clamped to a second compliant sealing member opening to a second conduit, thereby permitting access of gas for cleaning. Cleaning is by contaminant-free gas, such as chemically manufactured nitrogen, under pressure directed in two alternating directions, at least once in both directions. This removes particles. After that cleaning operation, the filters are then attached to the standpipes. These operations are done in a clean room. The cartridge is further processed, and once such a cartridge is finally assembled and filled with inkjet ink, significant reduction of clogging at the nozzles during normal use is realized.

BRIEF DESCRIPTION OF THE DRAWING

The details of this invention will be described in connection with the accompanying drawing, in which.

DESCRIPTION OF THE PREFERRED EMBODIMENTS

In the following description, the words "above", "below", "upwardly", "downwardly", "vertical", "horizontal", "top" and "bottom" are used as words of description rather than words of limitation since some inkjet cartridges may be disposed in different orientations depending upon the specific printer in which they are used.

Figure 1:
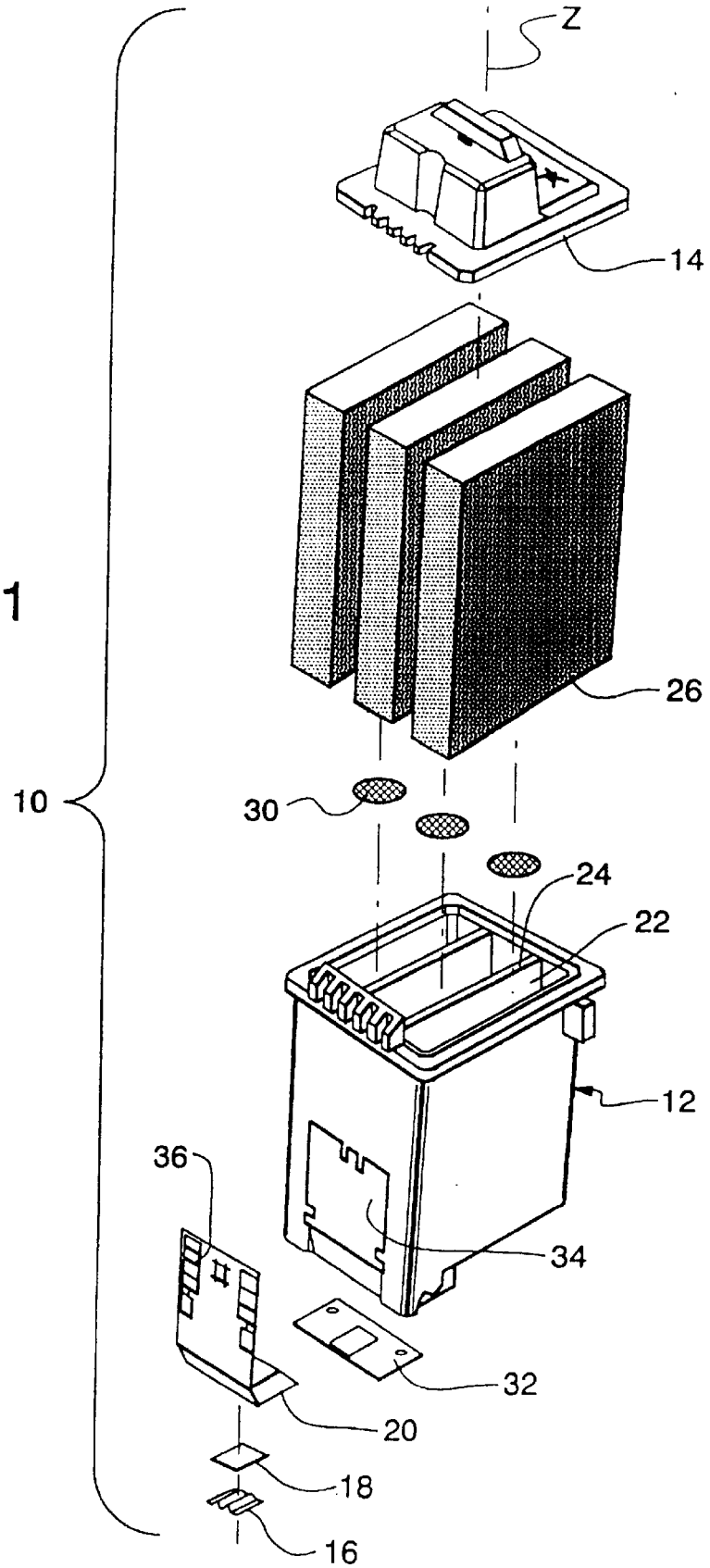
FIG. 1 is an exploded view of a typical tri-color inkjet cartridge which may be manufactured in accordance with this invention.
Figure 2:
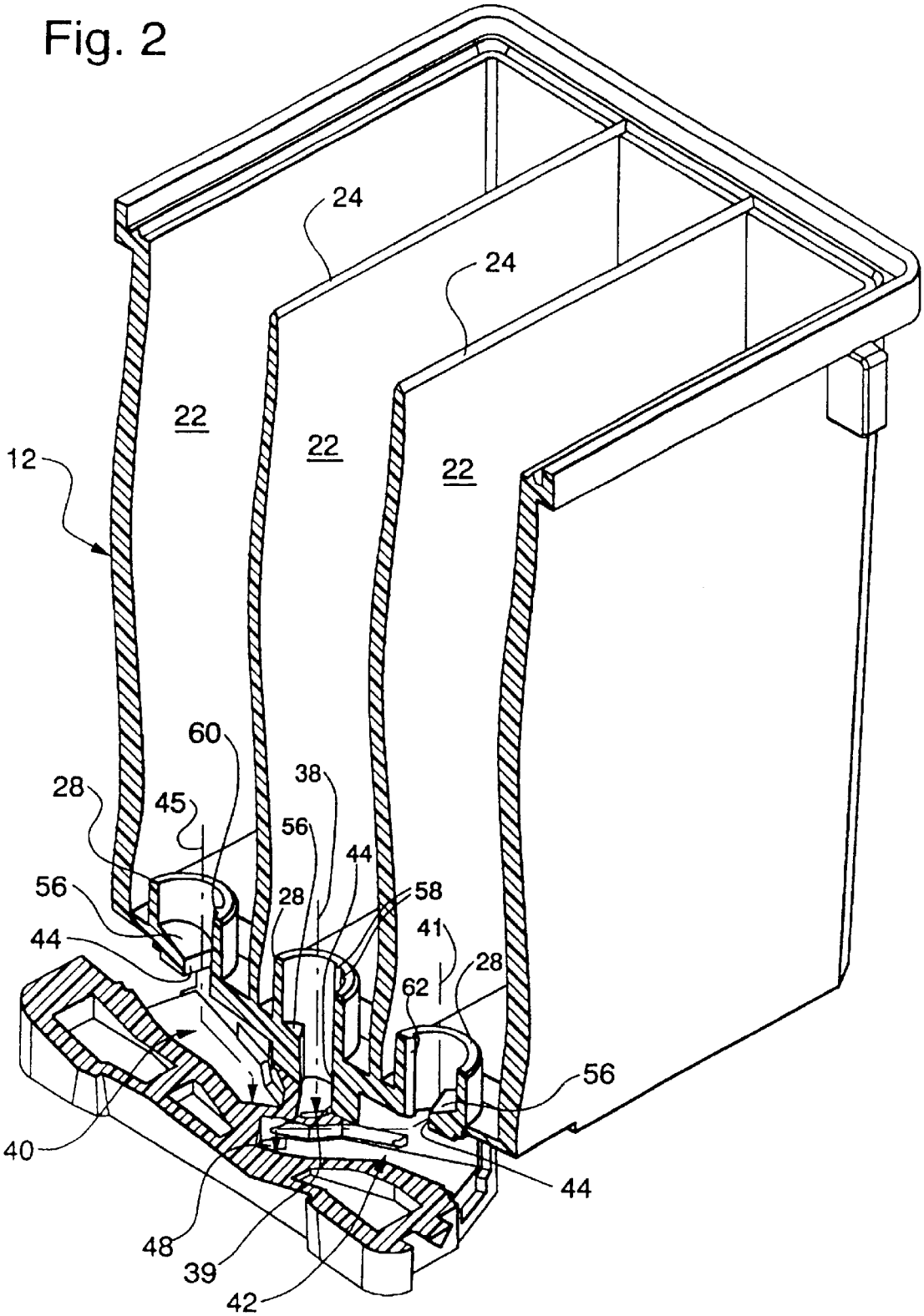
FIG. 2 is a perspective view of the cartridge body with a portion cut away, showing the connecting ducts (channels) 38, 41, 45 and standpipes 28.

Referring now to FIGS. 1 and 2, a tri-color inkjet cartridge or pen 10 comprises a cartridge body 12, a lid 14, a nozzle plate 16, a heater chip 18 and a tab circuit 20. The cartridge body 12 has a hollow interior divided into a center and two side ink reservoir chambers 22 by two dividing walls 24. Three blocks of foam material 26 are disposed in the reservoir chambers and the chambers are each filled with an ink of a different color. At the bottom of each reservoir chamber 22 is a standpipe 28 (FIG. 2) and the top of each standpipe is covered, as shown in FIG. 1, with a filter 30 for filtering the ink as it is sucked from a chamber.

The tab circuit 20 is attached to the bottom and front surface of cartridge body 12 by two adhesive preforms 32, 34. The tab circuit carries terminals 36 by means of which electrical signals are applied to control ejection of ink through nozzles in the nozzle plate 16. As is well known in the art, inks in the reservoir chambers 22 are sucked out of the chambers through filters 30 and the standpipes 28 when the nozzles are fired.

The cartridge body 12 is formed with three into flow pathways or passages (indicated by broken lines 38, 41, and 45 in FIG. 2), the pathways extending from reservoir chambers 22 to three exit ports 46, 48 and 50 (FIG. 3) located within a recess 52 in the bottom surface 54 of the cartridge body. It will be understood that the nozzle plate 16 and heater 18 comprise a print means and are mounted to the surface 54 so that the three colored inks available at openings 46, 48 and 50 may be selectively ejected through groups of nozzles in the nozzle plate to cause printing in a conventional manner.

The bottoms of standpipes 28 are partially closed by sloping bottom surfaces 56 (FIG. 2) so that the openings 44 of approximately semi-circular configuration are formed in the bottoms of the standpipes. The first ink flow pathway 38 extends from the center ink reservoir chamber 22 to exit port 46 and includes the center standpipe 28 and a short ink feed tube 39, the ink feed tube 39 extending parallel to the vertical or Z axis (FIG. 1) of the cartridge between opening 44 and exit port 46. Two ridges 58 are provided which extend along the entire length of the interior walls of the center standpipe 28 and feed tube 39. These ridges serve to wick ink from center chamber 22 and also prevent air bubbles from completely blocking the feed tube or standpipe.

The standpipes 28 for the side reservoir chambers 22 are also provided with ridges 60 and 62, respectively, extending vertically along the entire length of the interior walls of the standpipes. Only one ridge 60 and one ridge 62 is visible in FIG. 2.

The second ink flow pathway 41 extends from the right side ink reservoir chamber 22 of FIG. 2 to the exit port 48.

The second pathway includes the right-hand standpipe 28 of FIG. 2 and duct 42.

Figure 3:
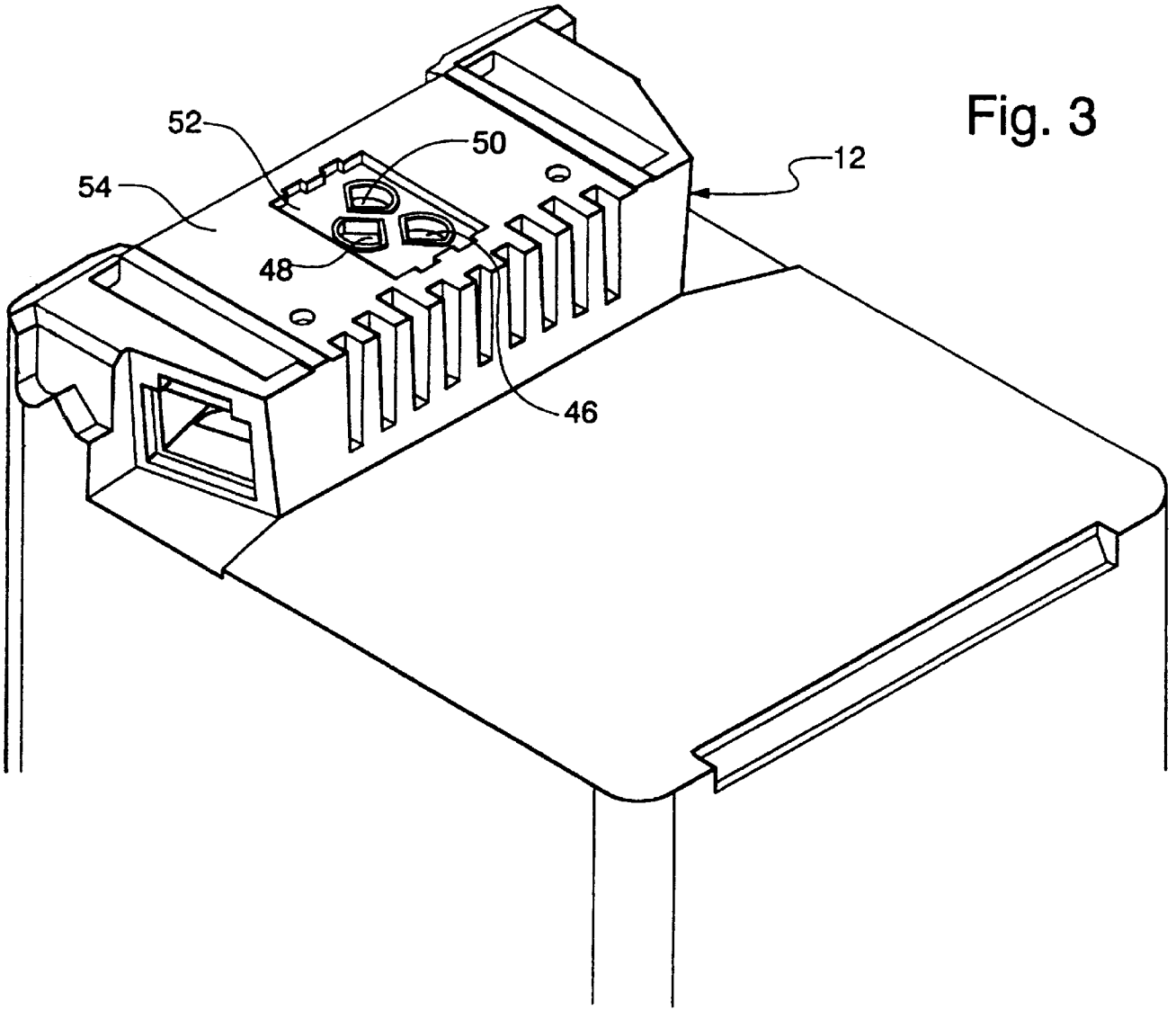
FIG. 3 is a perspective view of the bottom portion of the cartridge body showing the exit ports (ends of the channels) 46, 48, 50 through which ink exits through the cartridge body.

The third ink flow pathway 45 connects the left ink reservoir chamber 22 to the exit port 50 (FIG. 3). The pathway 45 is similar to the pathway 41 and is formed by left-hand standpipe 28 of FIG. 2 and duct 40.

This invention functions very well on conduits having irregular surfaces such as ledges 56. However, the details of such irregular surfaces are not limiting as adequate cleaning by this invention does not depend on such specific configuration, so long as gas under pressure can move strongly across every region which might contain contamination.

Figure 4:
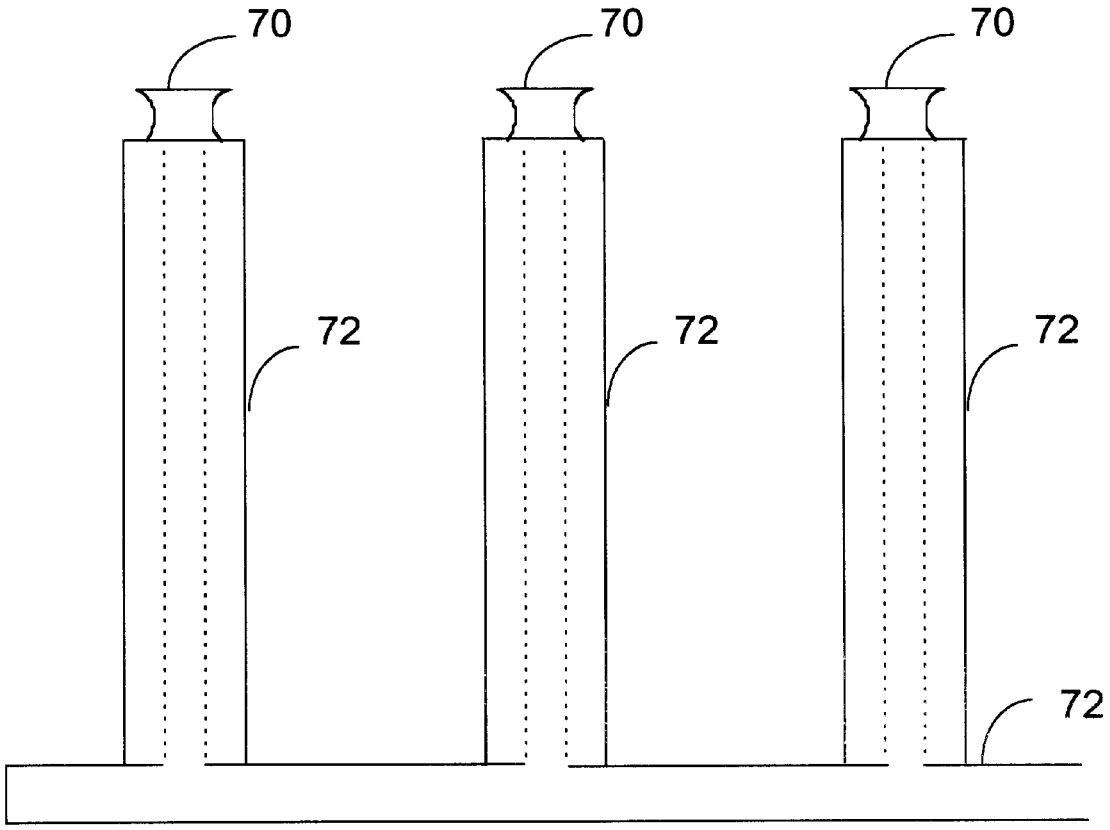
FIG. 4 illustrates a compliant cap 70 sealed by pressure around a standpipe.

As shown in FIG. 4, a compliant cup 70, is supported on and communicates with a rigid conduit 72 for gas. Each cup 70 is of size to close around each standpipe 28 (FIG. 2). Cup 70 may be made of a resilient natural material or polymer (such as polyurethane) so long as it has no tendency to flake or shed particles. Any commercially available artificial rubber cups are adequate. In the cleaning operation, cup 70 is sealed against the top of standpipe 28 by downward pressure. Conduit 72 is open to the inside of cup 70, and also has an interior which does not flake or shed particles.

Figure 5:
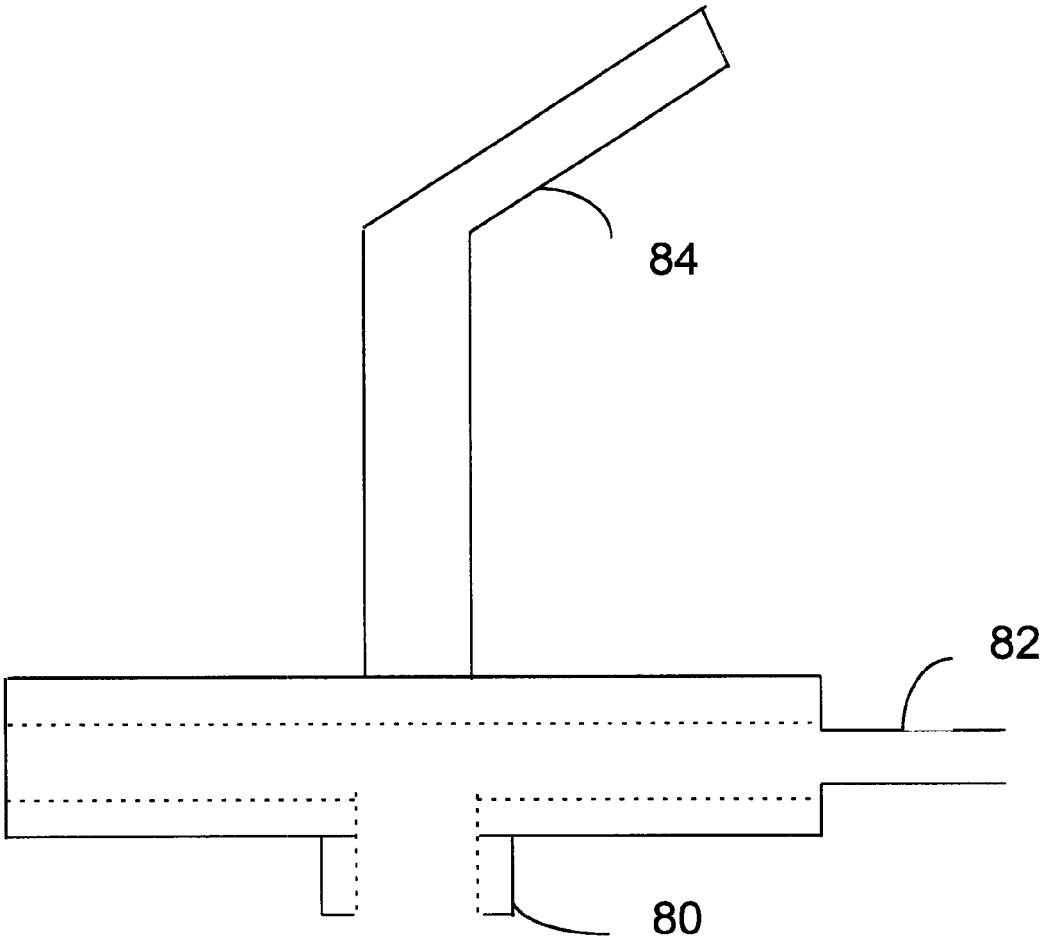
FIG. 5 illustrates a compliant cap sealed by pressure around the exit ports 80.

Shown in FIG. 5 is a second compliant cup 80, large enough to surround the three openings 46, 48 and 50 which contact chip 18. Cup 80 has a gas conduit 82 open to the inside of cup 80. The materials of cup 80 and conduit 82 preferably are of similar composition to those of cup 70 and conduit 72.

The empty cartridge 12 is placed in a fixture having cup 70 (three identical cups as shown in FIG. 4 in the case of the three chamber embodiment disclosed). Cup 80 is then sealed against the group of openings 46, 48 and 50 by pressure through a frame member 84 and latched downward by any conventional mechanical latch.

Figure 6:
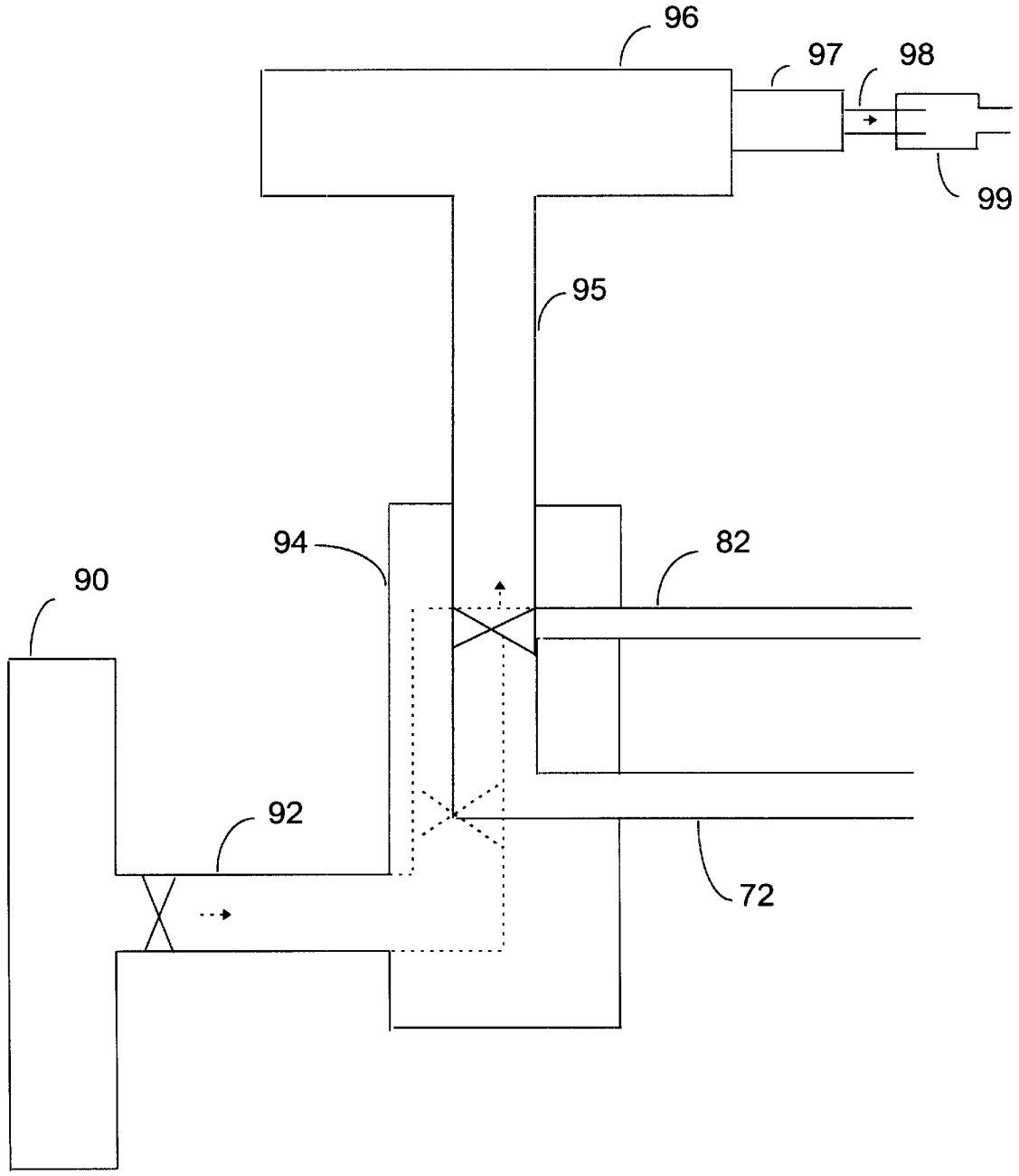
FIG. 6 illustrates the gas cleaning mechanism.

As shown illustratively in FIG. 6, contaminant-free gas, such as chemically-generated, contaminant-free nitrogen or highly filtered air, is held under pressure (50–120 psi) in a tank 90. Tank 90 as a source of low contamination gas, connects through a conduit 92 to a four-position valve 94. In a first position, the gas under pressure in tank 90 is applied to conduit 72, a first conduit, and a valve in conduit 82 connects conduit 82 to a vacuum generator 96, a source of low pressure, gas received by vacuum generator 96 is directed through a silencer 97 then through a very fine filter 99 so as to not vent contaminants into the clean room. Then, valve 94 is positioned for the gas from tank 90 to the first conduit flow to the second conduit, conduit 82, with the flow path from tank 90 to conduit 72 closed. In conjunction, the valve for vacuum flow from conduit 72 is opened, and the valve to allow flow from conduit 82 is closed. A microprocessor (not shown) controls the valve positions and is programmed to switch these valves to alternate the gas flow direction. Vacuum is applied to aid in the movement of larger particles (>20 microns) from inside the standpipe area. All elements of this operation are of material which does not flake or shed particles into the gas flow.

This alternating (back and forth) cycle is repeated 2–6 times. Typically, two cycles are sufficient. More than six cycles provide no benefit over six cycles. The reservoirs 22 are filled with inkjet ink and the cartridge 10 is completed. This cleaning process has significantly reduced contamination related defects during normal operation of cartridge 10.

Variations will be apparent and can be anticipated.

We claim:

1. A method of reducing particulate contamination in a filled inkjet cartridge having a cartridge body, a standpipe in a reservoir of said cartridge body and a conduit in said cartridge body connecting said standpipe to an opening on said cartridge body, said method comprising conducting the following steps conducted in a low contamination chamber or room:

applying a first sealing member connected to a first conduit for a gas to close around said standpipe in said reservoir, applying a second sealing member connected to a second conduit for said gas to said opening, alternatively connecting said first conduit to a source of low contamination gas under pressure while connecting said second conduit to a source of low pressure and connecting said second conduit to a source of low contamination gas under pressure while connecting said first conduit to a source of low pressure, and then filling said reservoir with inkjet ink.

2. The method as in claim 1 in which said gas alternatively connected to said first conduit and said second conduit is vented through a filter into said low contamination chamber or room.

3. The method as in claim 1 in which said alternatively connecting is by said first conduit being alternatively connected to said source of low contamination gas and to a filter, said second conduit being alternatively connected to the same said source of low contamination gas to which said first conduit is selectably connected and to the same said filter to which said first conduit is selectably connected.

4. A method of reducing particulate contamination in a filled inkjet cartridge having a cartridge body which defines a closed ink flow path having a first end inside the cartridge body and a second end in closed communication with an opening in the cartridge body prior to filling the cartridge with ink comprising conducting the following steps in a low contamination chamber or room:

alternatively supplying low contamination gas under pressure to the first end of the closed ink flow path while connecting the opening in the cartridge body to a source of low pressure and supplying low contamination gas under pressure to the opening in the cartridge body while connecting the first end of the closed ink flow path to a source of low pressure, alternating said supplying gas to said first end and said supplying gas to said opening so that said gas moves back and forth at least twice and said flow path is substantially cleaned of particulate contaminants.

* * * * *

UNITED STATES PATENT AND TRADEMARK OFFICE

CERTIFICATE OF CORRECTION

PATENT NO. : 6,003,983
DATED : December 21, 1999
INVENTOR(S) : E. F. Lowry et al.

It is certified that error appears in the above-identified patent and that said Letters Patent is hereby corrected as shown below:

Title page,
Below Item [73], Assignee, insert:

-- [*] Notice: This patent is subject to a terminal disclaimer. --

Signed and Sealed this

Sixth Day of May, 2003

JAMES E. ROGAN
*Director of the United States Patent and Trademark Office*